United States Patent [19]

Cenefels

[11] 4,410,564

[45] Oct. 18, 1983

[54] MANUFACTURING PROCESS FOR HEAT EMITTING PLATES

[75] Inventor: Joaquin F. Cenefels, Barcelona, Spain

[73] Assignee: Raivi S.A., Barcelona, Spain

[21] Appl. No.: 313,153

[22] Filed: Oct. 19, 1981

[51] Int. Cl.[3] ..... B05D 1/02; B05D 3/10; B05D 5/12

[52] U.S. Cl. ..... 427/123; 427/264; 427/287; 427/319; 427/422; 427/424

[58] Field of Search ..... 427/123, 264, 423, 125, 427/287, 424, 110, 422, 319; 29/611, 620

[56] References Cited

U.S. PATENT DOCUMENTS

| | | | |
|---|---|---|---|
| 2,689,803 | 9/1954 | Ackerman | 427/110 |
| 3,109,228 | 11/1963 | Dyke et al. | 427/123 X |
| 4,194,042 | 3/1980 | Dates et al. | 427/423 X |

FOREIGN PATENT DOCUMENTS

| | | | |
|---|---|---|---|
| 743915 | 1/1956 | United Kingdom | 427/123 |

*Primary Examiner*—Evan K. Lawrence

*Attorney, Agent, or Firm*—Holman & Stern

[57] ABSTRACT

A method for fabricating heat emitting plates permits such plates to be designed to have a wide variety of thermal emission characteristics. A metal plate is coated with dielectric material on both sides and then heated to 300° to 400° C. at which point it is sprayed by a molten conductive metal. The thickness of the molten conductive metal on the dielectric coating can be varied along the length of the plate by varying the speed of the mutual displacement between the spraying means and the plate during the spraying operation. A protective pattern is painted or otherwise deposited on the sprayed metal which is then subjected to a corrosive bath to eliminate all of the sprayed metal except that which is overlaid by the protective coating. The protective coating is then removed leaving a heating element of desired configuration to achieve the desired thermal emission characteristics of the plate. More than one heating element may be formed on any plate surface and each of such heating elements can be connected to different voltage levels to achieve different heating characteristics.

13 Claims, 9 Drawing Figures

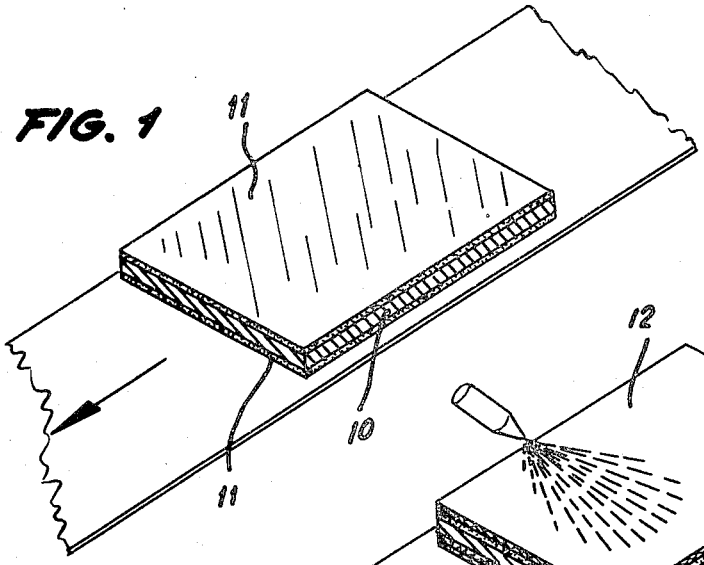
FIG. 1
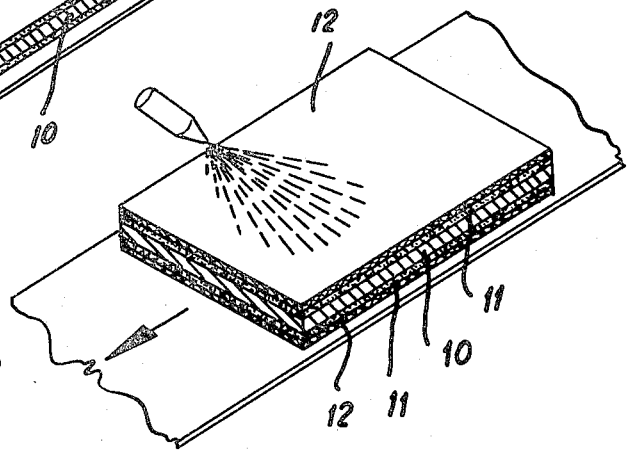
FIG. 2
FIG. 3
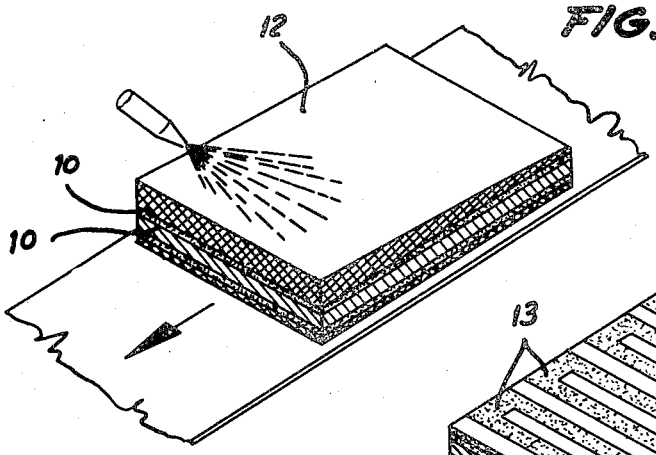
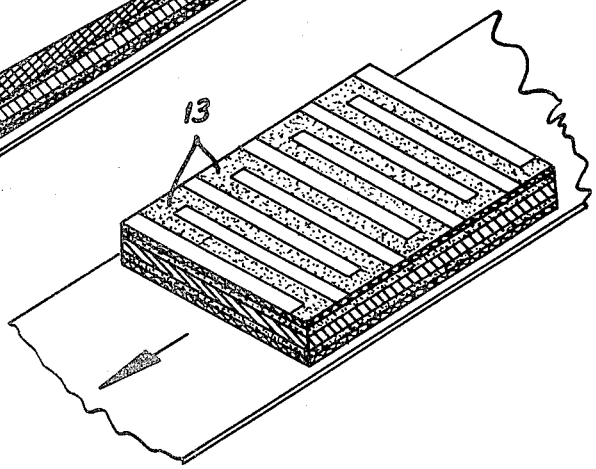
FIG. 4

MANUFACTURING PROCESS FOR HEAT EMITTING PLATES

TECHNICAL FIELD

The present invention relates to an improved process for manufacturing heat emitting plates. More particularly, the present invention relates to a process for manufacturing heat emitting plates which are capable of providing more controlled and efficient heating than is achieveable with prior art heat emitting plates.

BACKGROUND OF THE INVENTION

Heat emitting plates are presently extensively used as head radiating sources. Their wide use and acceptance can be attributed to their relatively small size, high heating efficiency, and low manufacturing costs, the latter resulting from the fact that the materials are inexpensive and the manufacturing process per se is quite simple. Other advantages of heat emitting plates reside in their versatility and capability of being readily adapted to a variety of heating uses, features which render them capable of solving a wide variety of practical heating problems.

Generally, heating plates, when positioned for use, are placed in an upright position. When so positioned, however, convection causes the heat radiated by the lower part of the plate to heat the upper part of the plate. This effect results in a marked difference of thermal energy throughout the plate since the lower part of the plate is able to reach the optimum temperature while this optimum temperature is exceeded in the upper part of the plate. This heat differential across the plate results in expansion and stress, both in the plate and in the supporting structure.

SUMMARY OF THE INVENTION

In accordance with the present invention, a process for manufacturing a heat emitting plate starts with a metal plate which is vitrified on both surfaces to insulate these surfaces. The vitrified plate is then heated in a conventional furnace at a temperature between 300° C. and 400° C. Molten conductive metal is then sprayed over one or both surfaces by transporting the plate past a spraying torch or nozzle which sprays the molten metal in a uniform pattern. By changing the speed of the transport mechanism, the thickness of the deposited metal can be varied along a plate surface. The surface is then painted in a prescribed pattern with a corrosion-protective material before the plate is submerged in a bath of a corrosive agent which eliminates those portions of the deposited metal which are not protected from the agent by the prescribed pattern of material.

The method described above permits the heating plate to have a variable thickness along different parts of its length in order to compensate for the effects of convection when the plate is in use, resulting in a uniform distribution of heat along the length of the plate. In fact, by properly selecting the prescribed pattern of the deposited metal on the plate, and by likewise controlling the thickness of the deposited metal along the length of the plate, a wide variety of heating needs are accomplished to fit specific applications. In other words, the present invention permits fabrication of heat emitting plates having a heat emitting characteristic which is uniformly distributed along the plate or, alternatively, distributed non-uniformly to serve a specific function.

The present invention also makes it possible to employ more than one circuit on a particular heat emitting plate so that different voltage levels can be applied to the various circuits to obtain different heat emission characteristics from a given plate.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein:

FIG. 1 is a view in perspective of a plate vitrified on both sides being transported in accordance with one step in the process of the present invention;

FIG. 2 is a view in perspective of the plate in FIG. 1 after it has been coated evenly with conductive material;

FIG. 3 is a view similar to that of FIG. 2 but wherein the conductive material has been applied unevenly to the plate;

FIG. 4 is a view in perspective illustrating a coated plate which has been painted with corrosion-resistant material;

DESCRIPTION OF THE PREFERRED EMBODIMENTS

Figure 5:
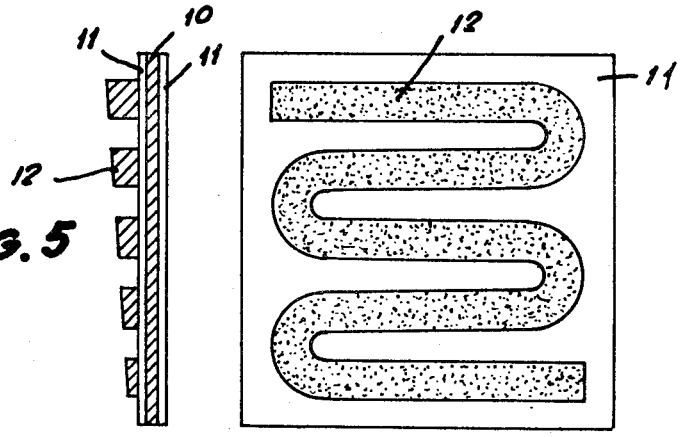
FIG. 5 is a view illustrating a plate which has been coated with an uneven distribution of conductive metal and subjected to a corrosive bath to remove the unwanted metal coating.

Referring specifically to FIG. 1 of the accompanying drawings, the process of the present invention begins with a metal plate 10 which is vitrified (i.e., coated with glass or similar dielectric material) on both surfaces with dielectric coatings 11. The vitrified plate is placed on a transport device which carries the plate to an oven wherein the vitrified plate is heated to a temperature of between 300° and 400° C. This heating increases the adherence between the vitreous coat and a molten metal film which is to be sprayed on one or both surfaces of the plate. Specifically, referring to FIG. 2, while the plate is being heated, it is sprayed by means of a molten metal spraying torch or nozzle. Specifically, the molten metal is sprayed onto the surface of the plate as it passes the torch or nozzle. The torch or nozzle sprays uniformly along the transverse dimension of the plate surface so that, if the transport speed of the plate is uniform, a metal coating 12 of uniform thickness is deposited on the dielectric coating 11. Coating 12 in FIG. 2 is illustrated as having such a uniform thickness. However, if the speed of the transport mechanism is varied during the passage of the plate past the spraying torch or nozzle, the thickness of coating 12 varies throughout the length of the plate. This feature is illustrated in FIG. 3 wherein a coating 12 of varying thickness is illustrated. Specifically, FIG. 3 illustrates an embodiment whereby the transport speed decreases gradually as the plate passes the torch or nozzle so that a uniform change in the thickness of coating 12 ensues. Of course, it is possible to vary the transport speed in any manner so as to obtain any desired type of thickness variation along the length of coating 12. It should also be noted that the nozzle or torch can be moved relative to the plate, rather than vice-a-versa to effect deposition of the molten metal coating 12 atop the dielectric coating 11. In other words, it is the relative motion, and the relative changes in velocity between the nozzle and plate which determine the coating distribution thickness. The important point to remember, however, is that the spraying means and/or the plate may be provided with a relatively uneven velocity and, since the exposure time changes in accordance with this velocity, the result will be an uneven change in the thickness of conductive material coating 12 on the dielectric coating 11.

Once coating 12 has been sprayed onto coating 11 in the desired thickness pattern, a prescribed pattern 13 of corrosion-protective material is painted onto the exposed surface of coating 12. This corrosion-protective material is in the form of a film of rubber, polyvinyl, or other material suitable to withstand the action of conventional corrosive agents utilized to etch away unwanted portions of the metal coating. The pattern 13 may take any prescribed form, depending upon the heat distribution requirements of the application for which the resulting heat emitting plate is intended.

Once pattern 13 is properly painted onto the surface of the plate, the plate is subjected to a conventional corrosive bath which eats away the exposed (i.e., unprotected) portions of metal coating 12.

What remains after the unwanted portions of coating 12 are removed is a prescribed pattern of metal which serves as a heating element on the surface of the plate.

Referring to FIG. 5, a heating element 12 extends continuously in a serpentine pattern along the length of the plate. If opposite ends of the pattern are connected to a voltage supply, current flows through the pattern of material 12 which heats up and emits thermal energy in accordance with its configuration. In the FIG. 5, it is assumed that the thickness of metal 12 is uneven along the length of the plate so that considerably more material is present along the bottom edge of the pattern (as viewed in FIG. 5) than at the top edge of the pattern. Since the resistivity of the metal coating 12 is inversely related to its cross-sectional area, the resistance per unit length of the pattern illustrated in FIG. 5 decreases from bottom to top. Since the resistivity of the pattern controls the heat dissipation of the pattern, it can be seen how the heat distribution from the heating plate can be tailored by appropriately configuring the pattern of material 12 and the thickness of that material as deposited on the plate.

Figure 6:
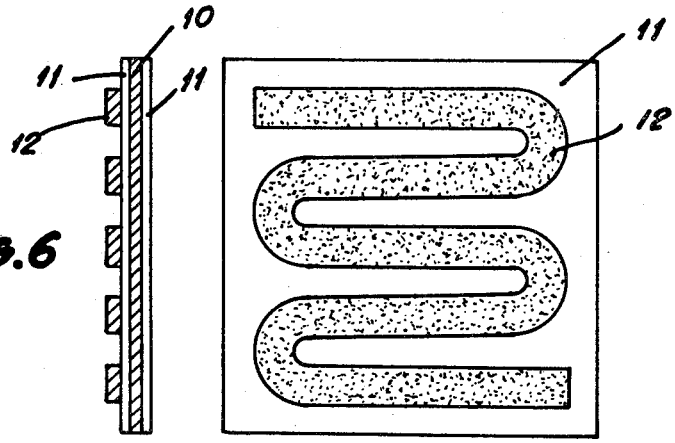
FIG. 6 is a view of a plate which has been coated evenly with conductive material and subjected to a bath to remove the unwanted metal.

FIG. 6 illustrates an embodiment similar to that of FIG. 5 but wherein the thickness of the pattern of material 12 is uniform throughout the length of the plate.

Figure 7:
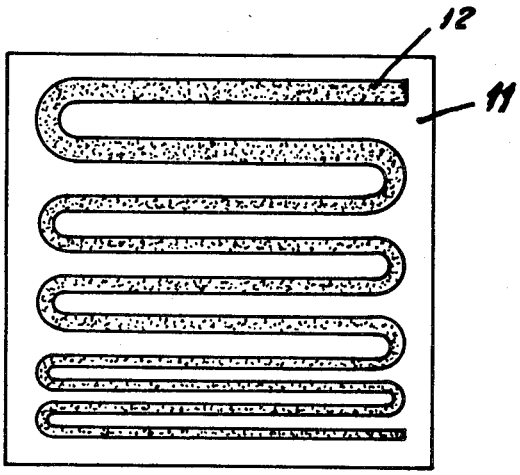
FIG. 7 is a plan view showing a plate wherein the pattern of material remaining after being subjected to a corrosive bath is non-uniform.

In FIG. 7 it is shown how the width of the serpentine pattern of material 12 can be varied throughout the length so as to provide another parameter to change to obtain a desired heat dissipation characteristic along the length of the plate. Thus, by selecting the prescribed pattern shape, length, thickness and/or width, one can fabricate each plate surface as desired to provide the required heat dissipation characteristic and, if desired, reduce differences in temperature between the upper and lower portions of the plate.

Figure 8:
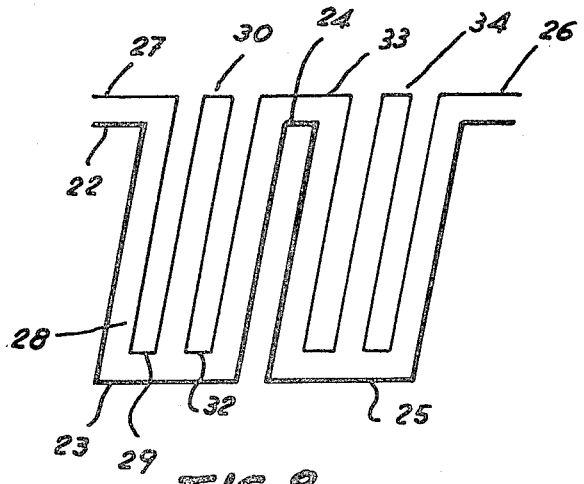
FIG. 8 is a diagrammatic representation of two separate patterns of heating material which may reside on the same finished heat emitting plate.

The process of the present invention makes it possible to fabricate heat emitting circuit elements which can employ more than one voltage. Specifically, it is possible to form two or more patterns on either surface of the plate; for example, two mutually insulated and spaced patterns. By varying the length, width and/or depth (or thickness) parameters of the different circuit patterns, the resistances can be tailored to achieve desired thermal emissive characteristics in response to different voltage levels applied to the patterns. For example, with reference to FIG. 8, a substantially serpentine circuit comprising elements 27, 28, 29, 30, 32, 33 and 34 is deposited along one surface of a plate along with another serpentine pattern comprising elements 22, 23, 24, and 25. It is clear that the first-mentioned circuit is substantially longer than the second. Therefore, the resistances of the two circuits differ and each emits a different radiation pattern. Moreover, each of the circuits can be connected to a different source of electrical power at different voltage levels to achieve the desired thermal emission characteristics.

Figure 9:
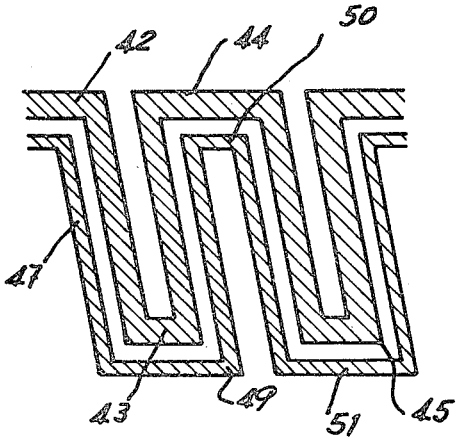
FIG. 9 is a diagrammatic illustration of two other patterns of heat emitting material which may be present on a single heat emitting plate in accordance with the present invention.

Another dual-circuit arrangement is illustrated in FIG. 9 wherein the serpentine pattern including elements 42, 43, 44, and 45 has a length substantially the same as the serpentine pattern or circuit comprising elements 47, 49, 50 and 51. However, it is clearly seen the widths of the two patterns differ considerably so that the respective heat dissipation characteristics of the two elements differ. Applied voltages at the same or different levels can further control the pattern of thermal distribution from a plate incorporating such circuits.

The present invention permits fabrication of heat emitting plates of widely different heat emission characteristics by merely tailoring the dimensions of the resistance pattern on the plate. The length, width and thickness of the resistance pattern or patterns is achieved simply and inexpensively and permits the system designer to have heating directed with greater accuracy than is possible in the prior art.

The invention described herein, in one embodiment, shows two circuits arranged on a heating plate. Clearly, more than two such circuits can be so arranged. In addition, apart from tailoring the characteristics of the circuits on the plate, the applied voltages can be selected to achieve the desired thermal emission characteristics.

While I have described and illustrated specific embodiments of my invention, it will be clear that variations of the details of construction which are specifically illustrated and described may be resorted to without departing from the true spirit and scope of the invention as defined in the appended claims.

I claim:

1. A method for manufacturing heat emitting plates comprising the steps of:

coating both surfaces of a metal plate with a dielectric coating;

heating the coated plate to a temperature between 300° C. and 400° C.; and spraying molten conductive metal over at least one of the coated surfaces in a manner such that the depth of the conductive metal sprayed onto the coated surface is uniform along any transverse section of the plate; wherein the step of spraying includes moving the plate relative to a spraying means at a relatively non-uniform speed so as to vary the thickness of the metal sprayed onto the plate along different portions of the length of the plate.

2. The method according to claim 1, further comprising the steps of applying a corrosion-protective material pattern onto the sprayed metal and removing the sprayed metal from the plate with a corrosive agent at locations other than those protected from the agent by the corrosion-protective material pattern.

3. The method according to claim 2, wherein the corrosion-protective material pattern is painted onto the plate on the sprayed metal and has a prescribed length and a width which varies throughout that length.

4. The method according to claim 2, wherein the corrosion protective material pattern has a prescribed length and a uniform width throughout that length.

5. The method according to claim 2, wherein said corrosion-protective material pattern is painted onto said sprayed metal and takes the form of at least two mutually insulated and spaced patterns.

6. The method according to claim 5, wherein said mutually insulated patterns have different lengths.

7. The method according to claim 5, wherein said mutually insulated patterns have different widths.

8. The method according to claim 2, wherein said pattern of corrosion-protective material includes a plurality of areas which are separated lengthwise along said plate.

9. The method according to claim 8, wherein said pattern has a zig-zag configuration.

10. The method according to claim 8, wherein said pattern has at least two uniformly spaced zig-zag sections.

11. The method according to claim 2, wherein said pattern is in the form of a zig-zag line of varying widths throughout its length.

12. The method according to claim 11, wherein the width of said zig-zag line gradually increases with its length.

13. The method according to claim 2, wherein the width of said pattern varies along the length of said plate.

* * * * *